US011077003B2

(12) United States Patent
He et al.

(10) Patent No.: US 11,077,003 B2
(45) Date of Patent: Aug. 3, 2021

(54) NURSING BED

(71) Applicant: Jiangsu Heng'ai Medical Equipment Co., Ltd, Yancheng (CN)

(72) Inventors: Hanzhong He, Yancheng (CN); Hang He, Shanghai (CN)

(73) Assignee: JIANGSU HENG'AI MEDICAL EQUIPMENT CO., LTD, Yancheng (CN)

( * ) Notice: Subject to any disclaimer, the term of this patent is extended or adjusted under 35 U.S.C. 154(b) by 58 days.

(21) Appl. No.: 16/497,751

(22) PCT Filed: Apr. 2, 2018

(86) PCT No.: PCT/CN2018/081522
§ 371 (c)(1),
(2) Date: Sep. 25, 2019

(87) PCT Pub. No.: WO2018/184507
PCT Pub. Date: Oct. 11, 2018

(65) Prior Publication Data

US 2020/0022857 A1 Jan. 23, 2020

(30) Foreign Application Priority Data

Apr. 3, 2017 (CN) ..... 201720343622.3
May 1, 2017 (CN) ..... 201720468847.1
May 13, 2017 (CN) ..... 201720528961.9

(51) Int. Cl.
*A61G 7/015* (2006.01)
*A61G 7/16* (2006.01)
(Continued)

(52) U.S. Cl.
CPC ..... *A61G 7/015* (2013.01); *A61G 7/16* (2013.01); *A61G 7/018* (2013.01); *A61G 7/1019* (2013.01)

(58) Field of Classification Search
CPC ..... A47C 20/041; A61G 7/05; A61G 7/16; A61G 7/018; A71G 7/1019
See application file for complete search history.

(56) References Cited

U.S. PATENT DOCUMENTS

2004/0034934 A1 2/2004 Weinman et al.
2014/0157515 A1* 6/2014 Manson ..... A61G 5/006 5/13

(Continued)

FOREIGN PATENT DOCUMENTS

CN 101773436 A 7/2010
CN 102327169 A 1/2012

(Continued)

OTHER PUBLICATIONS

International search report of PCT/CN2018/081522.
Written opinion of PCT/CN2018/081522.

*Primary Examiner* — David R Hare
*Assistant Examiner* — Adam C Ortiz
(74) *Attorney, Agent, or Firm* — Dragon Sun Law Firm, PC; Jinggao Li, Esq.

(57) ABSTRACT

A nursing bed, comprising: a back plate portion (1), a seat plate portion (2), a seat leg plate portion (3), a leg plate portion (4) and a foot plate portion (6), which are hinged in sequence, a bed body bracket (7), which configures the back plate portion (1), the seat plate portion (2) and the seat leg plate portion (3), the seat plate portion (2) being fixedly connected to the bed body bracket (7); a rotating shaft (10), which is arranged on the bed body bracket (7) and which is arranged at a lower side of the seat leg plate portion (3); a connecting rod (11) wherein an end is pivotably connected to the rotating shaft (10) while another end is movably connected to a lower surface of the foot plate portion (6).

18 Claims, 21 Drawing Sheets

(51) Int. Cl.
*A61G 7/018* (2006.01)
*A61G 7/10* (2006.01)

(56) References Cited

U.S. PATENT DOCUMENTS

| | | | | |
|---|---|---|---|---|
| 2014/0319804 | A1* | 10/2014 | Tsukada | A61G 7/00 280/648 |
| 2015/0067965 | A1* | 3/2015 | Xu | A61G 7/018 5/616 |
| 2018/0271731 | A1* | 9/2018 | Bellingroth | A61G 7/0515 |

FOREIGN PATENT DOCUMENTS

| | | | |
|---|---|---|---|
| CN | 203138923 | U | 8/2013 |
| CN | 104127289 | A | 11/2014 |
| CN | 204501325 | U | 7/2015 |

* cited by examiner

NURSING BED

CROSS-REFERENCE TO RELATED APPLICATIONS

This application is a national stage application of PCT Application No. PCT/CN2018/081522. This application claims priority from PCT Application No. PCT/CN2018/081522, filed Apr. 2, 2018 CN Application No. CN 201720343622.3 filed Apr. 3, 2017, CN 201720468847.1 filed May 1, 2017, and CN 201720528961.9 filed May 13, 2017 the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

TECHNICAL FIELD

The present disclosure relates to a nursing bed.

BACKGROUND

The existing nursing beds basically have the function of the back raising or the legs lifting. In addition to increasing the comfort of the patient lying down, the leg lifting function is also beneficial to increase the blood reflux of the patient during the treatment, which is very important for the ischemic emergency treatment of the patient. At the same time, when a person sits up, dropping feet is a kind of healthy behavior habit, which can increase the comfort of the patient, help the blood circulation, and prevent and treat diseases such as pneumonia and hemorrhoids. Since the requirements for the width of the seat plate are different when the legs are lifted or the feet are dropped, the seat plate should be narrower when the legs are lifted, so that the body weight can be laid on the leg plate and the foot plate; when the feet are dropped, the seat plate is required to be wider, so that the patient can sit comfortably. By this way, the principles of ergonomics can be satisfied, and the rehabilitation and physical and mental pleasure of patients can be helped. It is seemed to be very difficult to have different seat plate widths when the legs are lifted or the feet are dropped using a simple structure with the same driving push rod. The well-known nursing bed manufacturers make nursing beds which generally only have the leg lifting function, while the width of the seat plate and the width of the leg plate of the nursing beds that have the leg lifting function and the leg dropping function simultaneously, are not changed, which makes the patients uncomfortable due to the non-ergonomic design requirements. In addition, the tail of the bed with the foot dropping function needs to be suspended, which also affects the firmness and stability of the bed structure, thereby affects the realization of the foot dropping function of the nursing bed.

In addition, when a person sits up, dropping legs is a kind of healthy behavior habit, which can increase the comfort of the patient, help the blood circulation, and prevent and treat diseases such as pneumonia and hemorrhoids. However, the human body tends to slide down when sitting up or dropping leg as sitting up, especially those disabled person who do not have the ability to control their sitting posture are more difficult to sit stably. However, there exists not a kind of nursing bed that can prevent the human body from sliding down and increase the comfort of the person who sits up and down.

SUMMARY OF THE INVENTION

In order to solve at least one of the above technical problems, the present disclosure provides a nursing bed, comprises a back plate portion, a seat plate portion, a seat leg plate portion, a leg plate portion and a foot plate portion, the seat plate portion and the seat leg plate portion are hinged, and the leg plate portion and the foot plate portion are hinged; a bed body bracket, which configures the back plate portion, the seat plate portion and the seat leg plate portion, and the seat plate portion being fixedly connected to the bed body bracket; a rotating shaft, which is arranged on the bed body bracket and arranged at a lower side of the seat leg plate portion, and a connecting rod, wherein an end is pivotably connected to the rotating shaft, while another end is movably connected to a lower surface of the foot plate.

According to at least one embodiment of the present disclosure, wherein the seat leg plate portion and the leg plate portion are hinged by one of such means: a seamless abutting joint connecting; or a gap abutting joint connecting.

According to at least one embodiment of the present disclosure, wherein the seat leg plate portion and the leg plate portion are connected below by a hinge.

According to at least one embodiment of the present disclosure, wherein a clipping block is arranged on at least one of the opposite side surfaces of the seat leg plate portion and the leg plate when the seat leg plate portion and the leg plate portion are hinged by means of the gap abutting joint connecting.

According to at least one embodiment of the present disclosure, wherein the leg plate portion comprises a leg plate and a leg foot plate, and the leg plate and the leg foot plate are connected below by a hinge by means of the seamless abutting joint connecting or the gap abutting joint connecting, the leg foot plate and the foot plate are connected above by a hinge by means of the seamless abutting joint connecting or the gap abutting joint connecting.

According to at least one embodiment of the present disclosure, wherein the leg plate includes a center leg plate, a left leg plate and a right leg plate, and the left leg plate and the right leg plate are symmetrically arranged on both sides of the center leg plate; the leg foot plate includes a center leg foot plate, a left leg foot plate and a right leg foot plate, and the left leg foot plate and the right leg foot plate are symmetrically arranged on both sides of the center leg foot plate; the foot plate portion includes a center foot plate, a left foot plate and a right foot plate, and the left foot plate and the right foot plate are symmetrically arranged on both sides of the center leg plate; and the connecting rod includes a center connecting rod, the rotating shaft including a center rotating shaft, one end of the center connecting rod is pivotably connected to the center rotating shaft, the center connecting rod is movably connected to a lower surface of the center foot plate.

According to at least one embodiment of the present disclosure, wherein the two sides of the lower surface of the center foot plate are respectively provided with sustaining sticks extending to the lower side of the left foot plate and the right foot plate.

According to at least one embodiment of the present disclosure, wherein a left connecting rod is arranged on the lower surface of the left foot plate, and one end of the left connecting rod is movably connected to the lower surface of the left foot plate, and a left rotating shaft, which is concentrically connected to the central rotating shaft, is arranged on the bed body bracket, the other end of the left connecting rod is pivotably connected to the left rotating shaft; a right connecting rod is arranged on the lower surface of the right foot plate, and one end of the right connecting rod is movably connected to the lower surface of the right foot plate, and a right rotating shaft, which is concentrically connected to the central rotating shaft, is arranged on the bed body bracket, the other end of the right connecting rod is pivotably connected to the right rotating shaft.

According to at least one embodiment of the present disclosure, wherein both end surfaces of the central rotating shaft, the right end surface of the left rotating shaft, and the left end surface of the right rotating shaft are arranged with tenons and grooves, and the tenons and the grooves are concentrically connected.

According to at least one embodiment of the present disclosure, wherein the seat plate portion includes a center seat plate, a left leg plate and a right leg plate, the left leg plate and the right leg plate are symmetrically arranged on both sides of the center seat plate; the seat leg plate portion includes a center seat leg plate, a left seat leg plate and a right seat leg plate, and the left seat leg plate and the right seat leg plate are symmetrically arranged on both sides of the center seat leg plate.

According to at least one embodiment of the present disclosure, wherein the seat plate portion and the seat leg plate portion are integrally formed.

According to at least one embodiment of the present disclosure, wherein the seat plate portion is hinged to the bed body bracket, the nursing bed further comprises a horizontal connecting rod and a vertical connecting rod, the horizontal connecting rod is pivotably connected with the back plate portion, and is movably connected with the vertical connecting rod, the vertical connecting rod is rotatably connected with the bed body bracket.

According to at least one embodiment of the present disclosure, wherein the back plate portion and the seat plate portion are rotatably connected to the bed body bracket, and a first gear wheel portion is arranged on the side surface of the back plate portion, which is adjacent to the seat plate portion, and a second gear wheel portion, matching the first gear portion, is arranged on the side surface of the seat plate portion, which is adjacent to the back plate portion.

According to at least one embodiment of the present disclosure, wherein the end portion of the leg plate portion, which is adjacent to the seat plate portion, is hinged to the bed body bracket.

According to at least one embodiment of the present disclosure, wherein the leg plate portion is hinged to the bed body bracket with the connecting rod, and an upright baffle, used to prevent the leg plate portion from rotating, is arranged at the end portion of the connecting rod, which is hinged to the leg plate portion, and the connecting rod extends to the lower side of the seat plate portion.

According to at least one embodiment of the present disclosure, wherein the upright baffle is perpendicular to the upper surface of the connecting rod.

According to at least one embodiment of the present disclosure, wherein the bed body bracket is arranged under the back plate portion, the seat plate portion, and the seat leg plate portion, and surrounding the leg plate portion and the foot plate portion, and separated apart from the leg plate portion and the foot plate portion.

According to at least one embodiment of the present disclosure, wherein the bed body bracket is flush with the leg plate portion and the foot plate portion.

BRIEF DESCRIPTION OF THE DRAWINGS

The drawings illustrate exemplary embodiments of the present disclosure and, together with the description, serve to explain principles of the present disclosure. The accompanying drawings are included to provide a further understanding of the present disclosure, and are incorporated in and constitute a part of this specification.

DETAILED DESCRIPTION OF THE EMBODIMENTS

Figure 1:
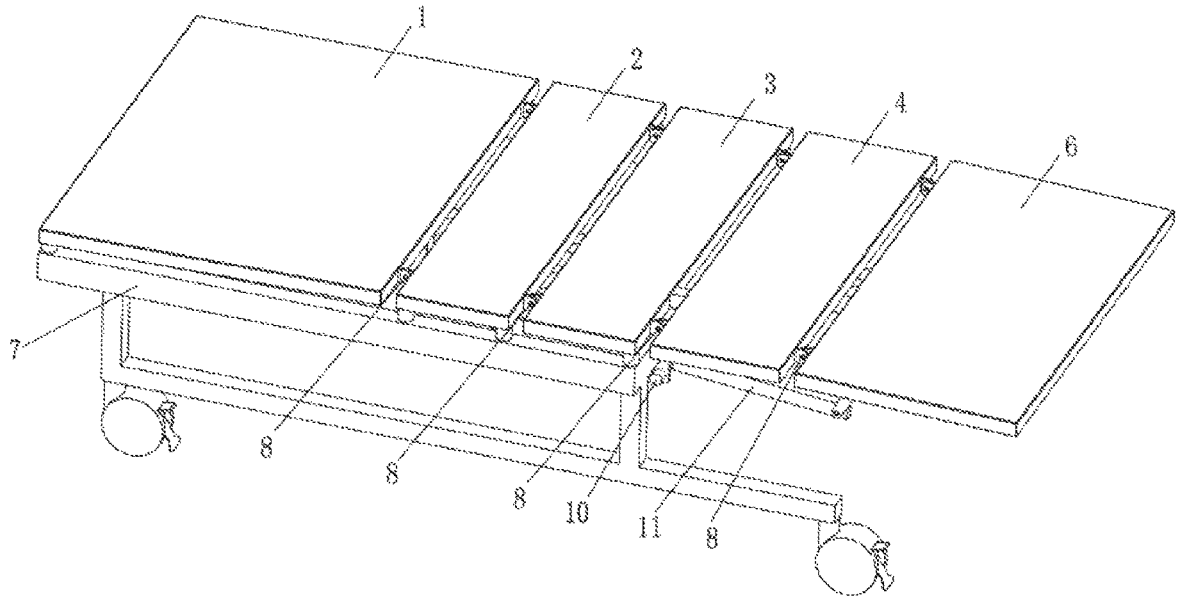
FIG. 1 is a structural schematic diagram of the bed plates distribution of a nursing bed in accordance with at least one embodiment of the present disclosure.

The present disclosure will be further described in detail below in conjunction with the drawings and embodiments. It is to be understood that the specific embodiments described herein are intended to be illustrative only and not limiting. It is also to be noted that, for the convenience of description, only parts related to the present disclosure are shown in the drawings.

It should be noted that the embodiments in the present disclosure and the features in the embodiments may be combined with each other without conflict. The present disclosure will be described in detail below with reference to the drawings and embodiments.

In at least one embodiment of the present disclosure, the present disclosure provides a nursing bed including a back plate portion, a seat plate portion, a seat leg plate portion, a leg plate portion, and a foot plate portion that are hinged in sequence, and a bed body bracket, which configures the back plate portion, the seat plate portion, and the seat leg plate portion, the seat plate portion being fixedly connected to the bed body bracket; a rotating shaft, which is arranged on the bed body bracket and which is arranged at a lower side of the seat leg plate portion; a connecting rod wherein an end is pivotably connected to the rotation shaft while another end is movably connected to a lower surface of the foot plate portion.

FIG. 1 is a structural schematic diagram of the bed plates distribution of a nursing bed in accordance with at least one embodiment of the present disclosure. As shown in FIG. 1, the nursing bed includes a back plate 1, a seat plate 2, a seat leg plate 3, a leg plate 4, and a foot plate 6 that are sequentially arranged. The back plate 1, the seat plate 2 and the seat leg plate 3 are arranged on the bed body bracket 7, and the seat plate 2 is fixedly connected to the bed body bracket 7. The back plate 1 and the seat plate 2, the seat plate 2 and the seat leg plate 3, and the leg plate 4 and the foot plate 6 are each connected by hinges 8. A rotating shaft 10 is arranged on the bed body bracket 7 and under the seat leg plate 3. One end of the connecting rod 11 is pivotably connected to the rotating shaft 10, and the other end is movably connected to the lower surface of the foot plate 6.

The bed body bracket 7 shown in FIG. 1 is only arranged under the back plate 1, the seat plate 2 and the seat leg plate 3, however, in some embodiments of the present disclosure, besides under the back plate 1, the seat plate 2 and the seat leg plate 3, the bed body bracket 7 may be arranged around the leg plate 4 and the foot plate 6. The bed body bracket 7 can be separated apart from the leg plate 4 and the foot plate 6. In an embodiment, the bed body bracket 7 can also be flush with the leg plate 4 and the foot plate 6. In this way, it is ensured that the leg plate 4 and the foot plate 6 can be freely dropped, and thereby the stability of the nursing bed is increased.

Figure 2:
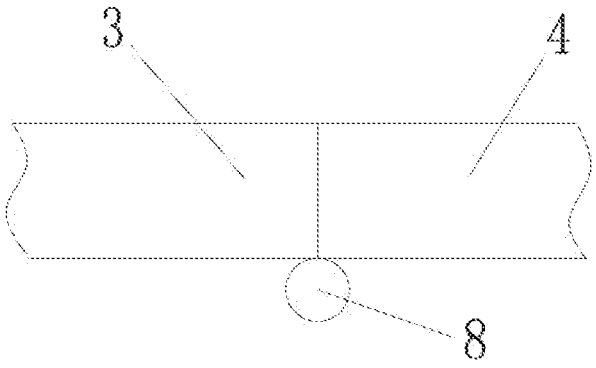
FIG. 2 is a structural schematic diagram of the seamless abutting joint connecting and the hinging below of the seat leg plate and the leg plate of the nursing bed in accordance with at least one embodiment of the present disclosure.

As shown in FIG. 2, according to some embodiments of the present disclosure, the seat leg plate 3 and the leg plate 4 can be seamlessly abutting joint connected, and the seat leg plate 3 and the leg plate 4 are connected below by a hinge 8.

Figure 3:
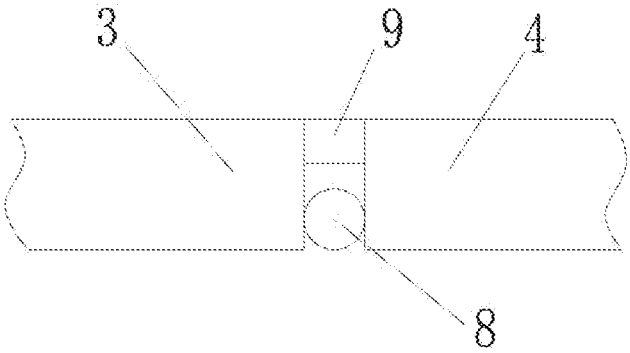
FIG. 3 is a structural schematic diagram of the arranging of the clipping block and the hinging below of the seat leg plate and the leg plate of the nursing bed in accordance with at least one embodiment of the present disclosure.

As shown in FIG. 3, according to other embodiments of the present disclosure, there may be sufficient gap between the seat leg plate 3 and the leg plate 4, in which the hinge 8 and a clipping block 9 are arranged, and the hinge 8 is arranged under the gap. The clipping block 9 may be arranged on at least one of the seat leg plate 3 and the leg plate 4. The arranged clipping block 9 should be away from the bedside, which can effectively prevent the hand clamping and meet the safety requirements of medical devices.

Figure 4:
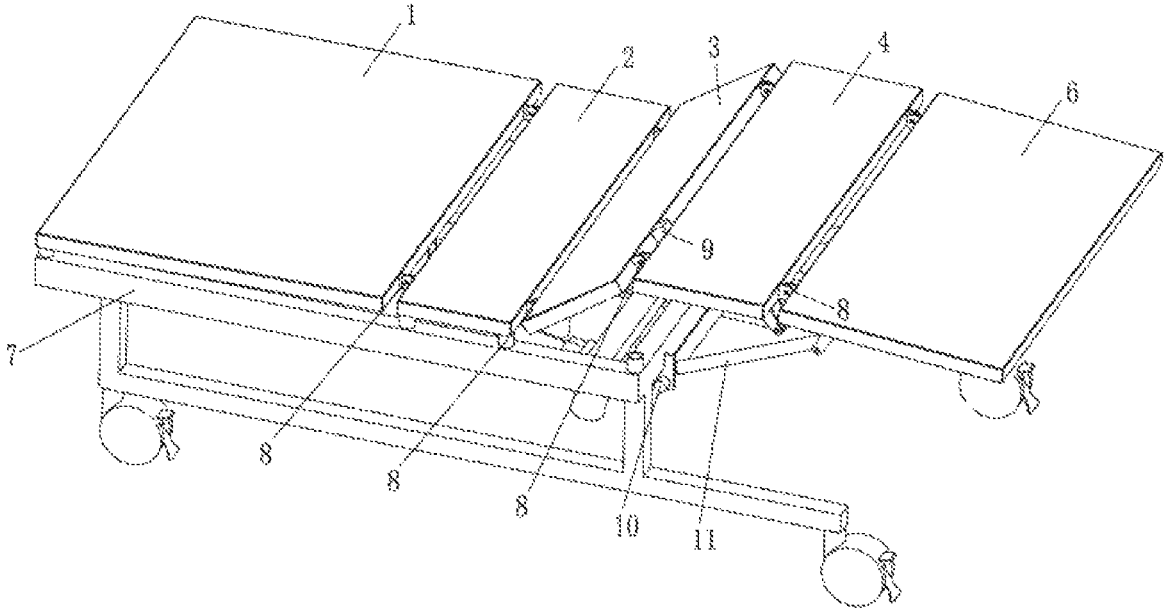
FIG. 4 is a structural schematic diagram of a leg lifting state of the nursing bed in accordance with at least one embodiment of the present disclosure.

FIG. 4 is a structural schematic diagram of a leg lifting state of the nursing bed in accordance with at least one embodiment of the present disclosure. As shown in FIG. 4, when the legs are lifted, one end of the connecting rod 11 is rotated around the rotating shaft 10 and the other end of the connecting rod 11 is moved to the first position along the lower surface of the foot plate 6, and the seat leg plate 3 is lifted and in a tilted state; meanwhile the leg plate 4 and the foot plate 6 are in a horizontal state. At this time, only a part of the human buttocks can occupy the narrower seat plate 2, and the weight of the human body mainly falls on the seat leg plate 3, which not only effectively lifts the human legs, but also increases the comfort of the person.

Figure 5:
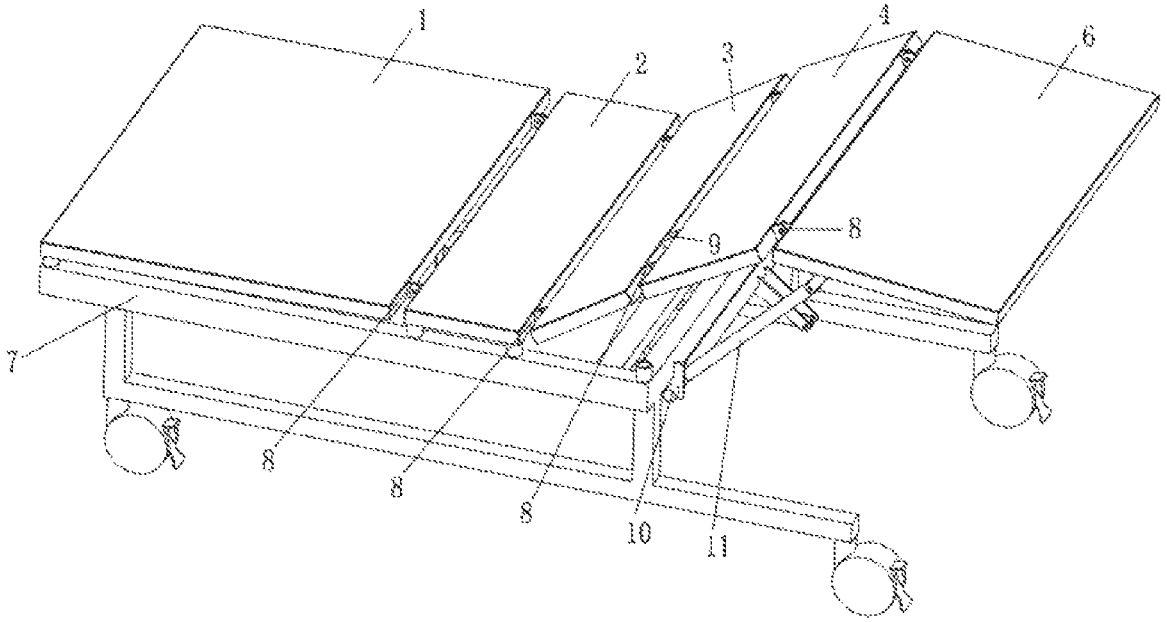
FIG. 5 is a structural schematic diagram of another leg lifting state of the nursing bed in accordance with at least one embodiment of the present disclosure.

FIG. 5 is a structural schematic diagram of another leg lifting state of the nursing bed in accordance with at least one embodiment of the present disclosure. As shown in FIG. 5, when the legs are lifted, one end of the connecting rod 11 is rotated around the rotating shaft 10 and the other end of the connecting rod 11 is moved to the second position along the lower surface of the foot plate 6, and the seat leg plate 3 and the leg plate 4 are lifted simultaneously and in a tilted state; meanwhile the foot plate 6 is in a horizontal state. The seat leg plate 3 and the leg plate 4 are connected in the manner shown in FIG. 2 or FIG. 3, which can effectively ensure that the seat leg plate 3 and the leg plate 4 are in the same plane. At this time, only a part of the human buttocks can occupy the narrower seat plate 2, and the weight of the human body mainly falls on the seat leg plate 3 and the leg plate 4, which can lift legs higher without affecting the comfort, as compared with the state shown in FIG. 4.

Figure 6:
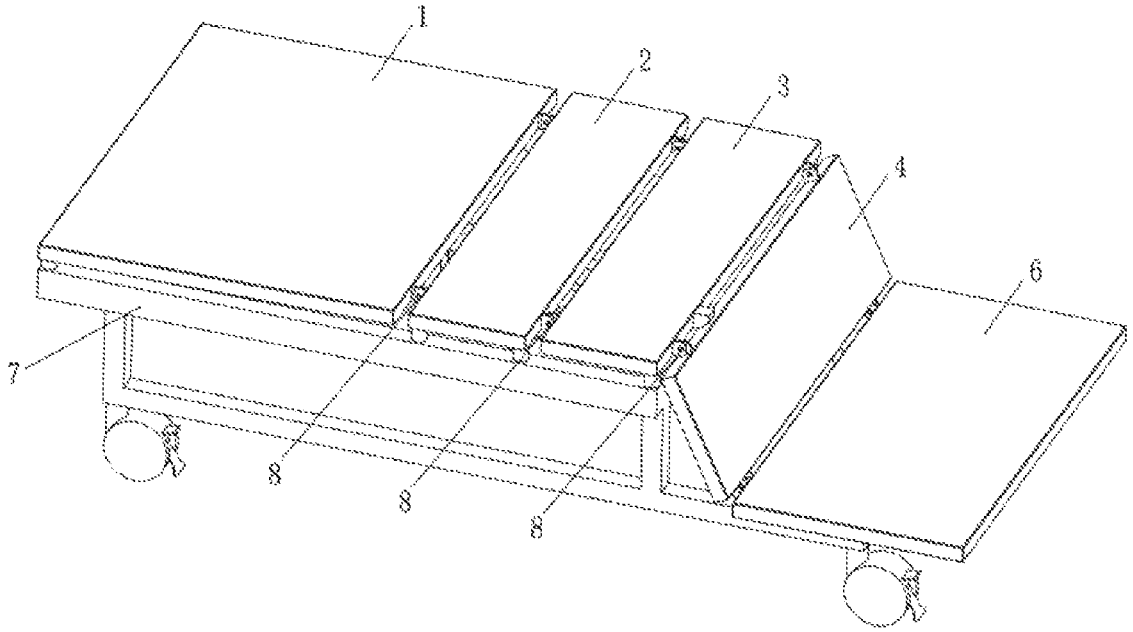
FIG. 6 is a structural schematic diagram of a foot dropping state of the nursing bed in accordance with at least one embodiment of the present disclosure.

FIG. 6 is a structural schematic diagram of a foot dropping state of the nursing bed in accordance with at least one embodiment of the present disclosure. As shown in FIG. 6, when the legs are dropped, the seat plate 2 and the seat leg plate 3 are retained on the bed body bracket 7, and the leg plate 4 is dropped, in a tilted or vertical state, and the foot plate 6 is in a horizontal state. At this time, the human buttocks can occupy both the seat plate 2 and the seat leg plate 3, which can ensure sufficient seat width, have an ideal height of the legs dropping, meet the ergonomic requirements and ensure the sitting comfort of the patient.

Figure 7:
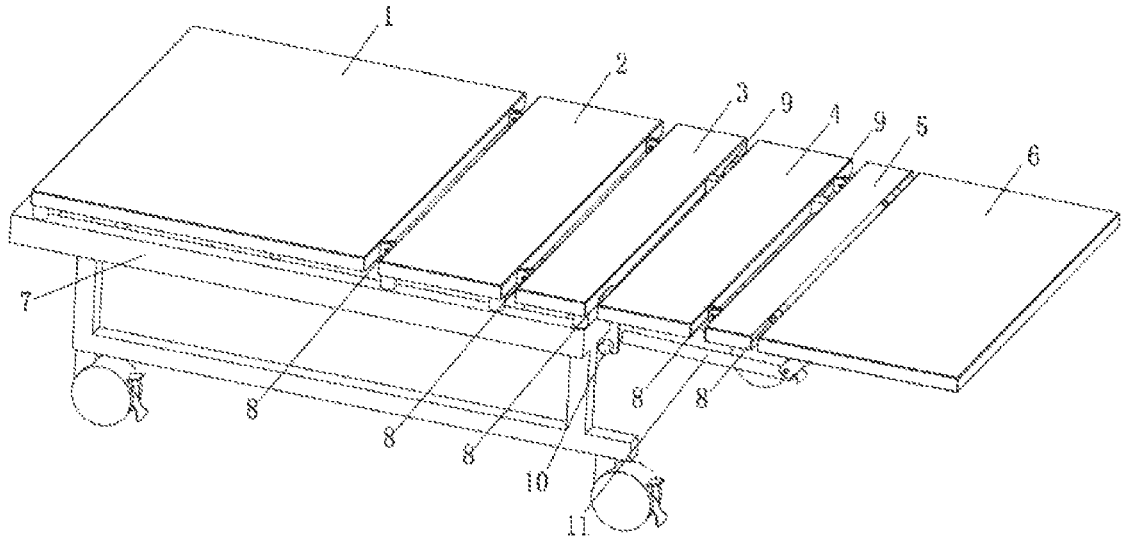
FIG. 7 is a structural schematic diagram of the nursing bed in accordance with at least one embodiment of the present disclosure.

FIG. 7 is a structural schematic diagram of the nursing bed in accordance with at least one embodiment of the present disclosure. As shown in FIG. 7, the nursing bed includes a back plate 1, a seat plate 2, a seat leg plate 3, a leg plate 4, a leg foot plate 5, and a foot plate 6, which are sequentially arranged. The back plate 1, the seat plate 2 and the seat leg plate 3 are arranged on the bed body bracket 7, and the seat plate 2 is fixedly connected to the bed body bracket 7. Every plate is connected with each other by the hinge 8. A rotating shaft 10 is arranged on the bed body bracket 7 and under the seat leg plate 3. One end of the connecting rod 11 is pivotably connected to the rotating shaft 10, and the other end is movably connected to the lower surface of the foot plate 6.

The bed body bracket 7 shown in FIG. 7 is arranged only under the back plate 1, the seat plate 2 and the seat leg plate 3, however, in some embodiments of the present disclosure, besides under the back plate 1, the seat plate 2 and the seat leg plate 3, the bed body bracket 7 may be arranged around the leg plate 4, the leg foot plate 5 and the foot plate 6. The bed body bracket 7 can be separated apart from the leg plate 4, the leg foot plate 5 and the foot plate 6. In an embodiment, the bed body bracket 7 can also be flush with the leg plate 4, the leg foot plate 5 and the foot plate 6. In this way, it is possible to ensure that the leg plate 4, the leg foot plate 5 and the foot plate 6 can freely be dropped, and the stability of the nursing bed is increased.

Figure 8:
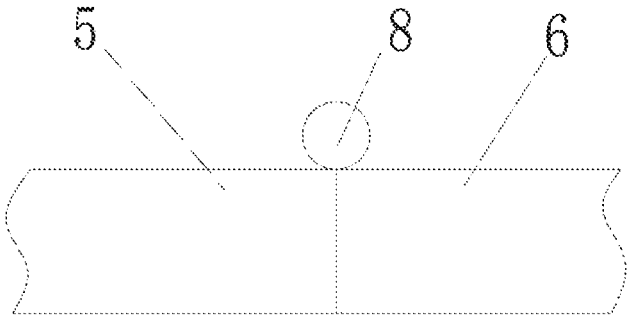
FIG. 8 is a structural schematic diagram of the seamless abutting joint connecting and the hinging above of the leg foot plate and the foot plate of the nursing bed in accordance with at least one embodiment of the present disclosure.

According to some embodiments of the present disclosure, as shown in FIG. 2, the seat leg plates 3 and the leg plates 4 of the nursing bed may be seamlessly abutting joint connected, and the seat leg plates 3 and the leg plates 4 are connected below by the hinge 8. As shown in FIG. 2, the leg plate 4 and the leg foot plate 5 can be seamlessly abutting joint connected, and the leg plate 4 and the leg foot plate 5 are connected below by the hinge 8. As shown in FIG. 8, the leg foot plate 5 and the foot plate 6 can be seamlessly abutting joint connected, and the leg foot plate 5 and the foot plate 6 are connected above by the hinge 8.

Figure 9:
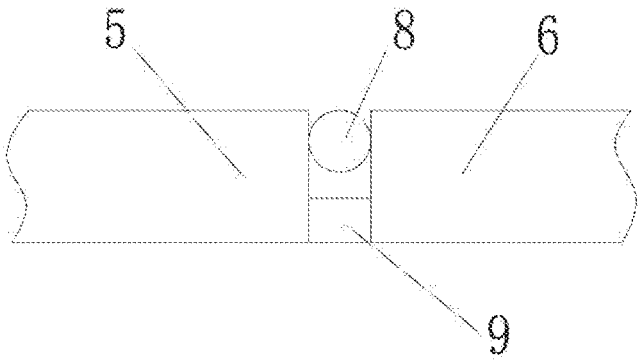
FIG. 9 is a structural schematic diagram of the arranging of the clipping block and the hinging above of the leg foot plate and the foot plate of the nursing bed in accordance with at least one embodiment of the present disclosure.

According to further embodiments of the present disclosure, as shown in FIG. 3, there may be sufficient gap between the seat leg plate 3 and the leg plate 4, in which the hinge 8 and the clipping block 9 are arranged, and the hinge 8 is arranged under the gap. The clipping block 9 may be arranged on at least one of the seat leg plate 3 and the leg plate 4. As shown in FIG. 3, there may be sufficient gap between the leg plate 4 and the leg foot plate 5, in which the hinge 8 and the clipping block 9 are arranged, and the hinge 8 is arranged under the gap. The clipping block 9 may be arranged on at least one of the leg plate 4 and the leg foot plate 5. As shown in FIG. 9, there may be sufficient gap between the leg foot plate 5 and the foot plate 6, in which the hinge 8 and the clipping block 9 are arranged, and the hinge 8 is arranged above the gap. The clipping block 9 may be arranged on at least one of the leg foot plate 5 and the foot plate 6. The arranged clipping block 9 should be away from the bedside, which can effectively prevent the hand clamping and meet the safety requirements of medical devices.

Figure 10:
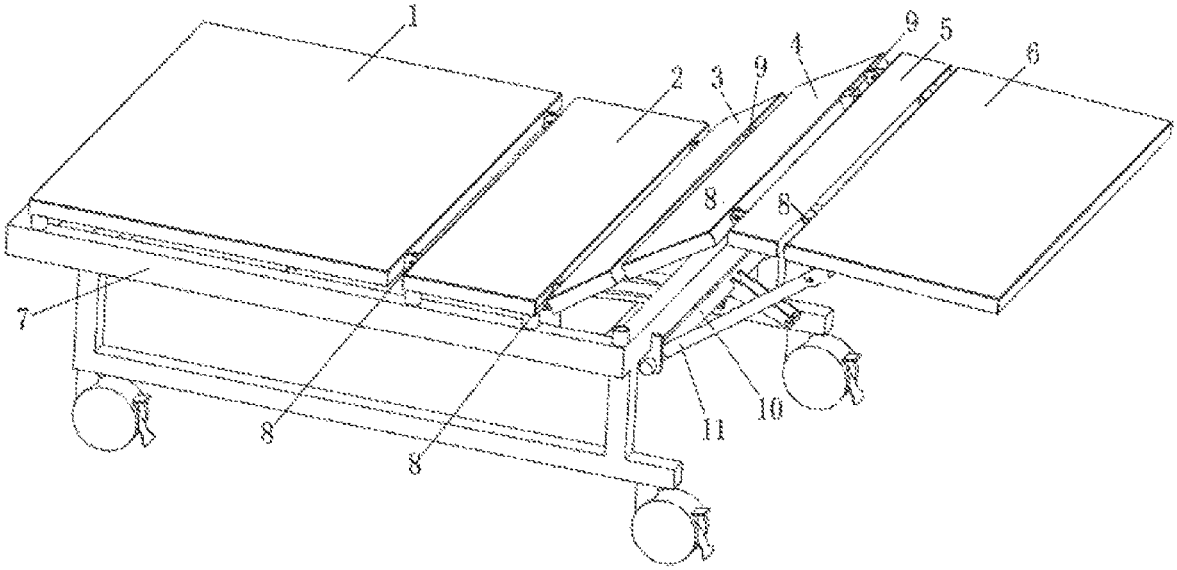
FIG. 10 is a structural schematic diagram of a leg lifting state of the nursing bed in accordance with at least one embodiment of the present disclosure.

FIG. 10 is a structural schematic diagram of a leg lifting state of the nursing bed in accordance with at least one embodiment of the present disclosure. As shown in FIG. 10, when the legs are lifted, one end of the connecting rod 11 is rotated around the rotating shaft 10 and the other end of the connecting rod 11 is moved along the lower surface of the foot plate 6, and the seat leg plate 3 and the leg plate 4 are lifted simultaneously and in a tilted state; meanwhile the leg foot plate 5 and the foot plate 6 are in a horizontal state. The seat leg plate 3 and the leg plate 4 are connected in the manner shown in FIG. 2 or FIG. 3, which can effectively ensure that the seat leg plate 3 and the leg plate 4 are in the same plane. Similarly, the leg foot plate 5 and the foot plate 6 are connected in the manner shown in FIG. 8 or FIG. 9, which can effectively ensure that the leg foot plate 5 and the foot plate 6 are in the same plane. At this time, only a part of the human buttocks can occupy the narrower seat plate 2, and the weight of the human body mainly falls on the seat leg plate 3 and the leg plate 4, which not only can effectively lift the human legs, but also increase the comfort of the person.

Figure 11:
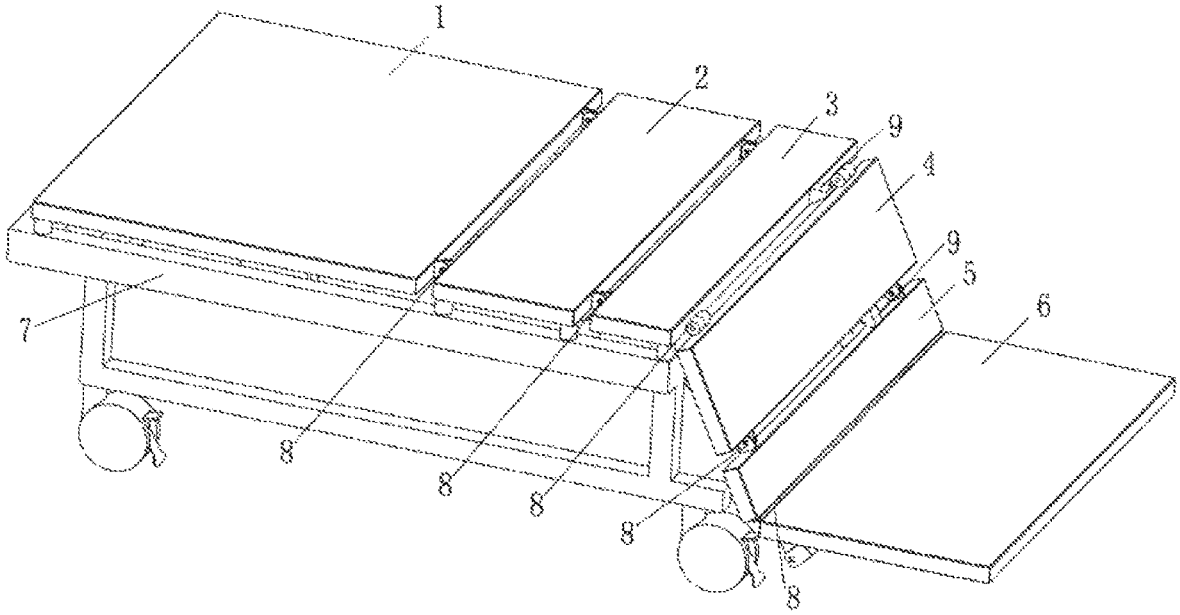
FIG. 11 is a structural schematic diagram of a foot dropping state of the nursing bed in accordance with at least one embodiment of the present disclosure.

FIG. 11 is a structural schematic diagram of a foot dropping state of the nursing bed in accordance with at least one embodiment of the present disclosure. As shown in FIG. 11, when the legs are dropped, the seat plate 2 and the seat leg plate 3 are retained on the bed body bracket 7, and the leg plate 4 and the leg foot plate 5 are dropped, in a tilted or vertical state, and the foot plate 6 is in a horizontal state. The leg plate 4 and the leg foot plate 5 are connected in the manner shown in FIG. 2 or FIG. 3, which can effectively ensure that the leg plate 4 and the leg foot plate 5 are in the same plane. At this time, the human buttocks can occupy both the seat plate 2 and the seat leg plate 3, which can ensure sufficient seat width, have an ideal height of the legs dropping, meet the ergonomic requirements and ensure the sitting comfort of the patient.

Figure 12:
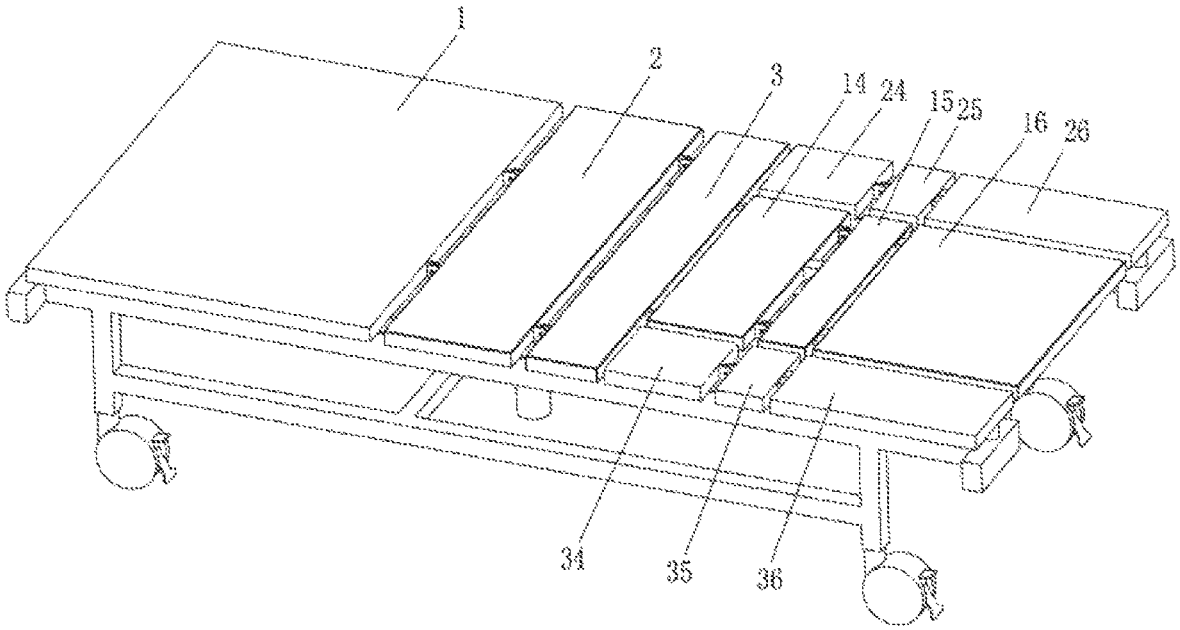
FIG. 12 is a structural schematic diagram of the bed plates distribution of the nursing bed in accordance with at least one embodiment of the present disclosure.
Figure 13:
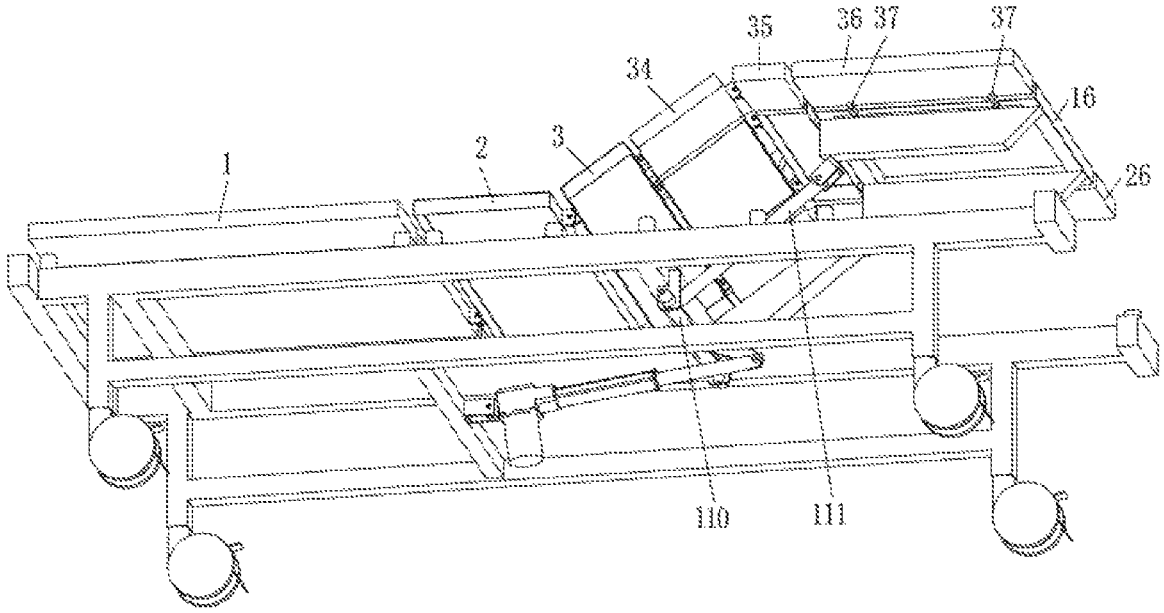
FIG. 13 is a structural schematic diagram of a leg lifting state of the nursing bed in accordance with at least one embodiment of the present disclosure.

FIG. 12 is a structural schematic diagram of the bed plates distribution of a nursing bed in accordance with at least one embodiment of the present disclosure. As shown in FIGS. 12 and 13, the nursing bed includes a central leg plate 14, a left leg plate 24 and a right leg plate 34, the left leg plate 24 and the right leg plate 34 are symmetrically arranged on both sides of the center leg plate 14. The nursing bed further includes a center leg foot plate 15, a left leg foot plate 25 and a right leg foot plate 35, and the left leg foot plate 25 and the right leg foot plate 35 are symmetrically arranged on both sides of the center leg foot plate 15. The nursing bed further includes a center foot plate 16, a left foot plate 26 and a right foot plate 36, and the left foot plate 26 and the right foot plate 36 are symmetrically arranged on both sides of the center foot plate 16. The nursing bed further includes a center connecting rod 111, a rotating shaft 10 including a center rotating shaft 110, one end of the center connecting rod 111 is pivotably connected to the center rotating shaft 110, the center connecting rod 111 is movably connected to a lower surface of the center foot plate 16. The width of the center leg plate 14, the center leg foot plate 15 and the center foot plate 16 is about 400 mm to 600 mm. The rest of the arrangement and connection are the same as in the embodiment shown in FIG. 7. Compared with the design in FIG. 1 or FIG. 7, the bed body bracket 7 extends, the firmness and stability of the bed structure are improved, and the function of the foot dropping of the nursing bed is effectively ensured.

As shown in FIG. 13, according to another embodiment of the present disclosure, the two sides of the lower surface of the center foot plate 16 are respectively provided with sustaining sticks 37 extending to the left foot plate 26 and the right foot plate 36, so that the left foot plate 26 and the right foot plate 36 can be lifted up with the center foot plate 16 together.

Figure 14:
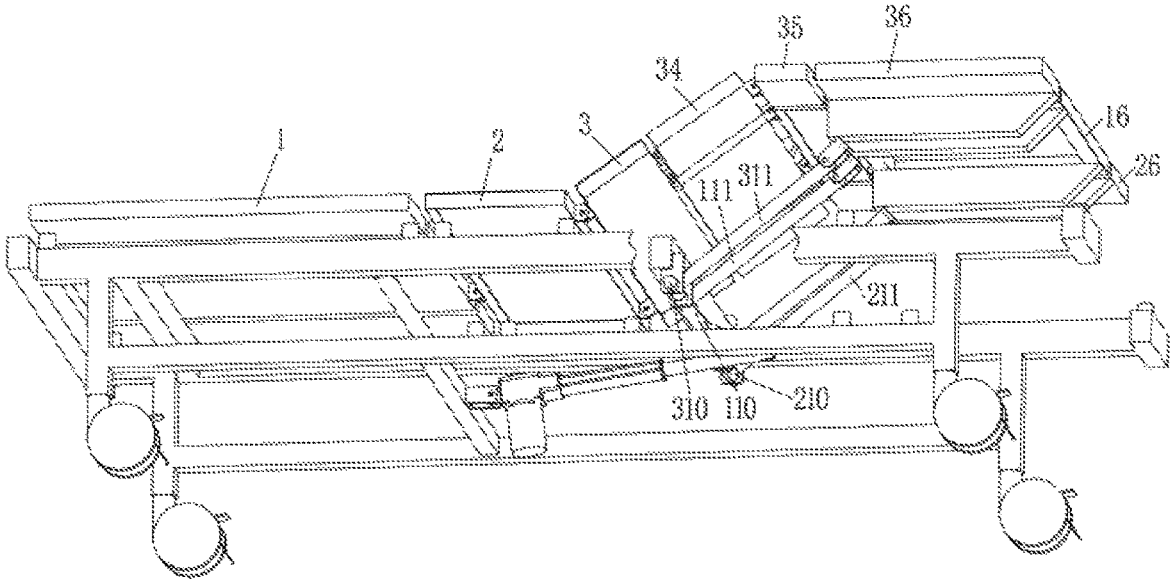
FIG. 14 is a structural schematic diagram of a leg lifting state of the nursing bed in accordance with at least one embodiment of the present disclosure.
Figure 15:
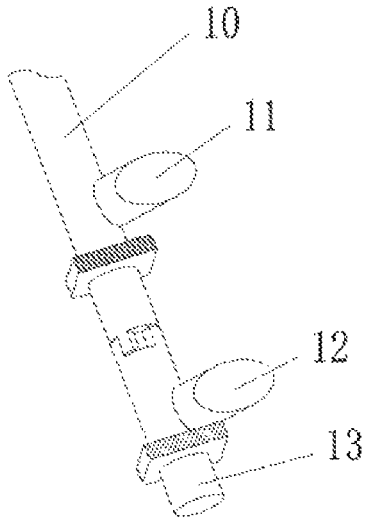
FIG. 15 is a structural schematic diagram of the connecting of a central rotating shaft and a right rotating shaft of the nursing bed in accordance with at least one embodiment of the present disclosure.

As shown in FIG. 14, according to another embodiment of the present disclosure, a left connecting rod 211 is arranged on the lower surface of the left foot plate 26, and one end of the left connecting rod 211 is movably connected to the lower surface of the left foot plate 26, and a left rotating shaft 210, which is concentrically connected to the central rotating shaft 110, is arranged on the bed body bracket 7, the left connecting rod 211 is pivotably connected to the left rotating shaft 210; a right connecting rod 311 is arranged on the lower surface of the right foot plate 36, and one end of the right connecting rod 311 is movably connected to the lower surface of the right foot plate 36, and a right rotating shaft 310, which is concentrically connected to the central rotating shaft 110, is arranged on the bed body bracket 7, the right connecting rod 311 is pivotably connected to the right rotating shaft 310. As shown in FIG. 15, both end surfaces of the central rotating shaft 110, the right end surface of the left rotating shaft 210, and the left end surface of the right rotating shaft 310 are arranged with tenons and grooves, and the tenons and the grooves are concentrically connected.

Returning to FIG. 13, FIG. 13 is a structural schematic diagram of a leg lifting state of the nursing bed in accordance with at least one embodiment of the present disclosure. As shown in FIG. 13, when the legs are lifted, one end of the center connecting rod 111 is rotated around the center rotating shaft 110 and the other end of the center connecting rod 111 is moved along the lower surface of the center foot plate 16, and the seat leg plate 3, the center leg plate 14, the left leg plate 24 and the right leg plate 34 are lifted simultaneously and in a tilted state; meanwhile the center leg foot plate 15, the left leg foot plate 25, the right leg foot plate 35, the center foot plate 16, the left foot plate 26 and the right foot plate 36 are in a horizontal state. The seat leg plate 3 and the center leg plate 14 are connected in the manner shown in FIG. 2 or FIG. 3, which can effectively ensure that the seat leg plate 3 and the center leg plate 14 are in the same plane. Similarly, the center leg foot plate 15 and the center foot plate 16 are connected in the manner shown in FIG. 8 or FIG. 9, which can effectively ensure that the leg foot plate 5 and the foot plate 6 are in the same plane. At the same time, the two sustaining sticks 37 arranged on the lower surface of the center leg plate 16 enable the left foot plate 26 and the right foot plate 36 to be lifted simultaneously with the center foot plate 16 together. At this time, only a part of the human buttocks can occupy the narrower seat plate 2, and the weight of the human body mainly falls on the seat leg plate 3 and the center leg plate 14, the left leg plate 24 and the right leg plate 34, which not only effectively lifts the human legs, but also increases the comfort of the person.

Similarly, as shown in FIG. 14, the two sustaining sticks 37 arranged on the lower surface of the center foot plate 16 are replaced with the left connecting rod 211 arranged on the lower surface of the left foot plate 26 and the right connecting rod 311 arranged on the lower surface of the right foot plate 36. Such design also ensures that the left foot plate 26 and right foot plate 36 can be lifted simultaneously with the center foot plate 16 together. The status of the other parts is the same as that shown in FIG. 13, and will not be described again here.

Figure 16:
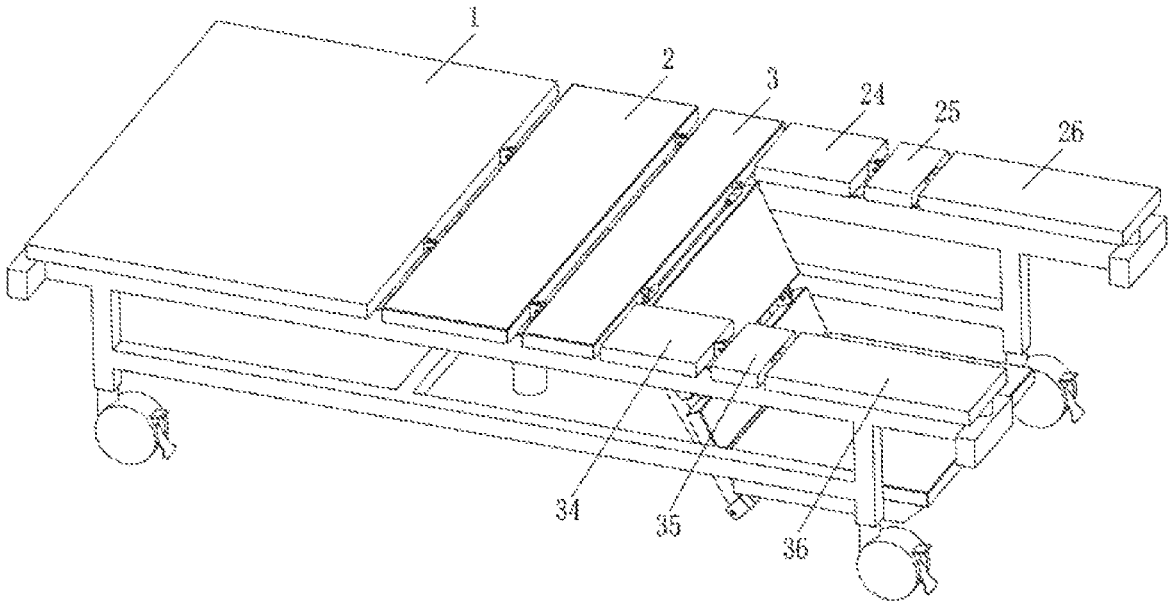
FIG. 16 is a structural schematic diagram of a leg dropping state of the nursing bed in accordance with at least one embodiment of the present disclosure.

FIG. 16 is a structural schematic diagram of a leg dropping state of the nursing bed in accordance with at least one embodiment of the present disclosure. As shown in FIG. 16, when the legs are dropped, the seat plate 2, and the seat leg plate 3, the left leg plate 24, the right leg plate 34, the left leg foot plate 25, the right leg foot plate 35, the left foot plate 26 and the right foot plate 36 are retained on the bed body bracket 7, and the center leg plate 14 and the center leg foot plate 15 are dropped, in a tilted or vertical state, and the center foot plate 16 is in a horizontal state. The center leg plate 14 and the center leg foot plate 15 are connected in the manner shown in FIG. 2 or FIG. 3, which can effectively ensure that the center leg plate 14 and the center leg foot plate 15 are in the same plane. At this time, the human buttocks can occupy both the seat plate 2 and the seat leg plate 3, which can ensure sufficient seat width, have an ideal height of the legs dropping, meet the ergonomic requirements and ensure the sitting comfort of the patient.

Figure 17:
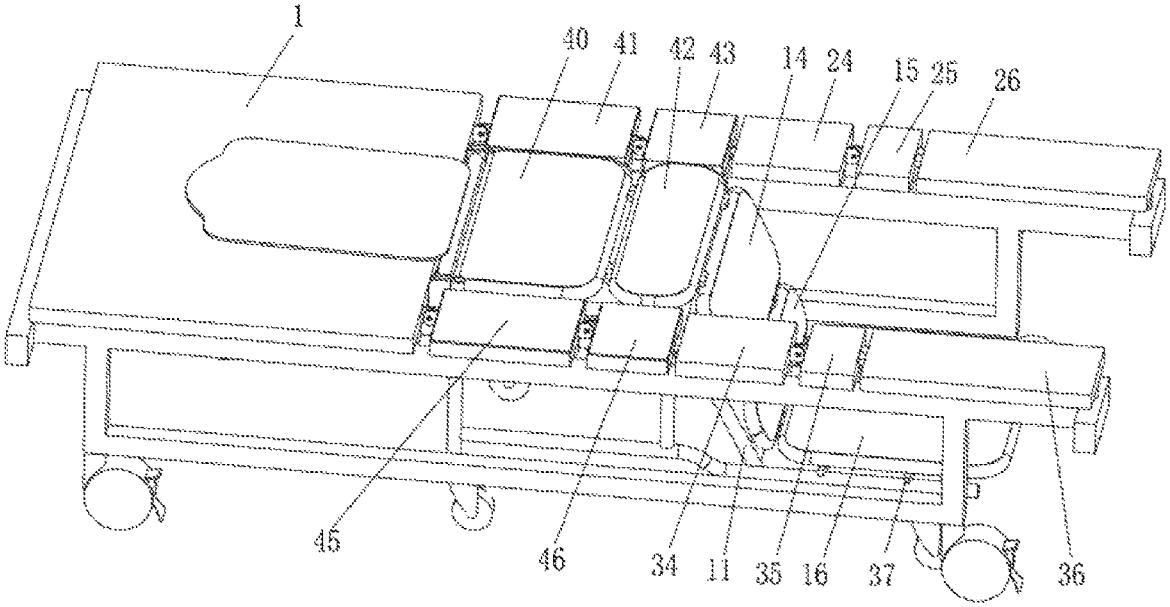
FIG. 17 is a structural schematic diagram of a leg dropping state of the nursing bed in accordance with at least one embodiment of the present disclosure.

FIG. 17 is a structural schematic diagram of a leg dropping state of the nursing bed in accordance with at least one embodiment of the present disclosure. As shown in FIG. 17, the seat plate 2 includes a central seat plate 40, a left leg plate 41 and a right leg plate 45, the left leg plate 41 and the right leg plate 45 are symmetrically arranged on both sides of the center seat plate, and the seat leg plate 3 includes a central seat leg plate 42, a left seat leg plate 43 and a right seat leg plate 46, the left seat leg plate 43 and the right seat leg plate 46 are symmetrically arranged on both sides of the center seat leg plate 42. The rest of the arrangement and connection are the same as in the embodiment shown in FIG. 12. As shown in FIG. 17, wheels are arranged under the center seat plate 40 and under the center foot plate 16, so that the nursing bed shown in FIG. 17 can be used as a wheelchair, expanding the usable scope of the nursing bed.

Figure 18:
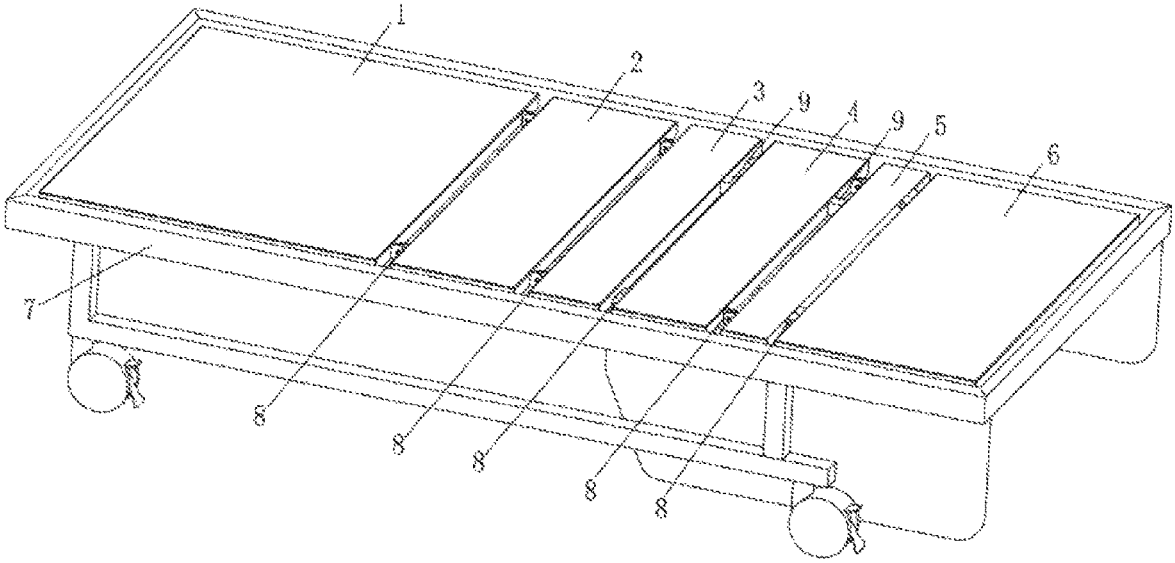
FIG. 18 is a structural schematic diagram of the nursing bed in accordance with at least one embodiment of the present disclosure.
Figure 19:
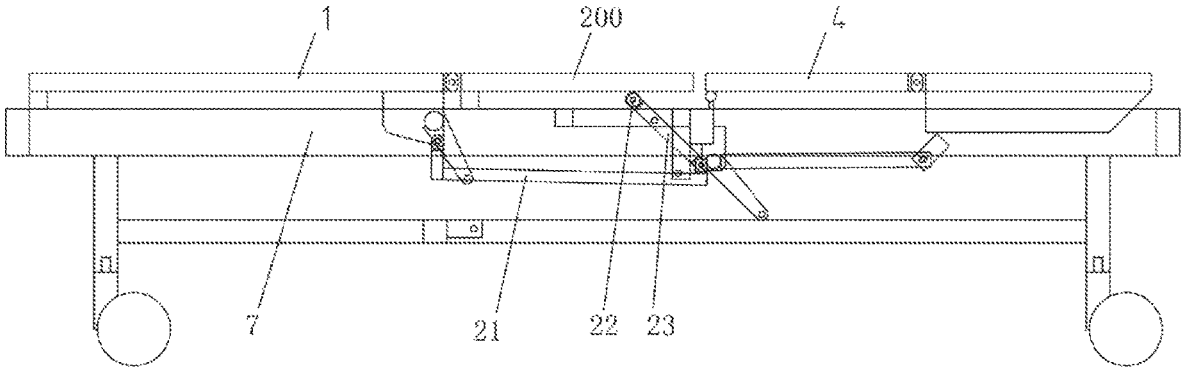
FIG. 19 is a structural schematic diagram of a leg lifting and dropping bed for preventing a person from sliding down when sitting up or down in accordance with at least one embodiment of the present disclosure.
Figure 20:
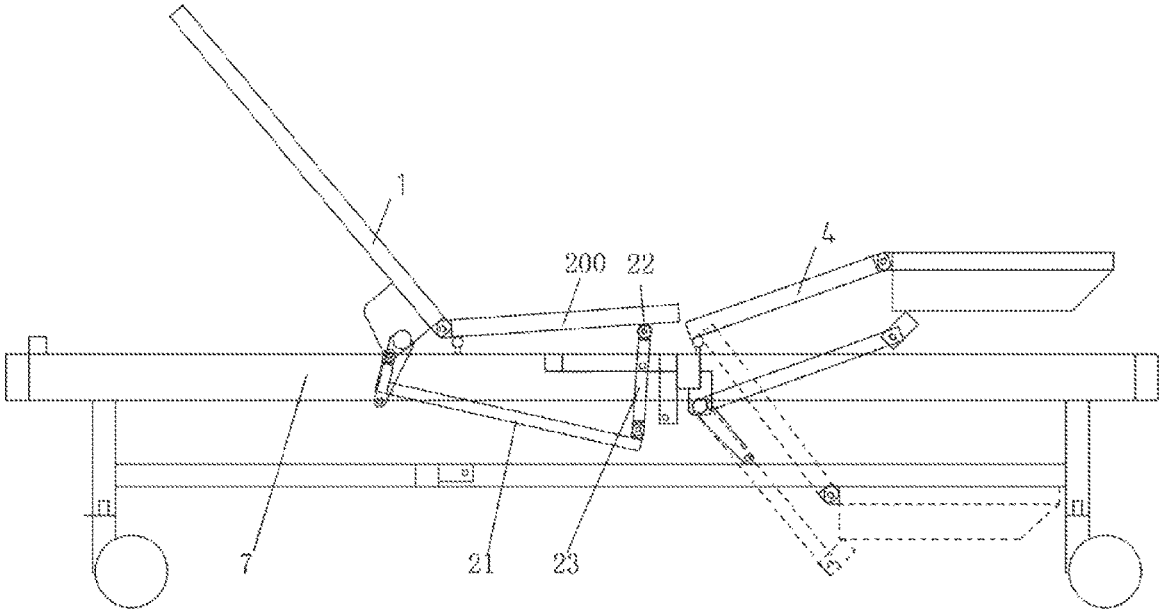
FIG. 20 is a working state schematic diagram of a leg lifting and dropping bed for preventing a person from sliding down when sitting up or down in accordance with at least one embodiment of the present disclosure.
Figure 21:
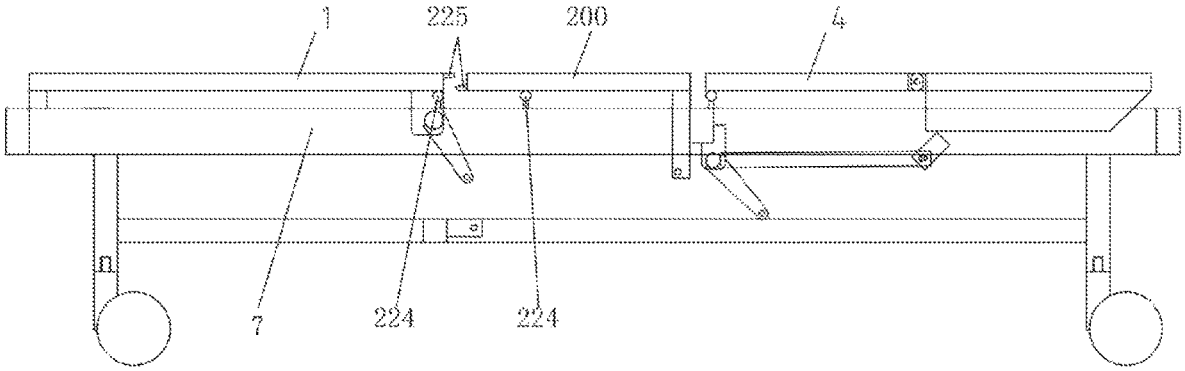
FIG. 21 is a structural schematic diagram of a leg lifting and dropping bed for preventing a person from sliding down when sitting up or down in accordance with at least one embodiment of the present disclosure.
Figure 22:
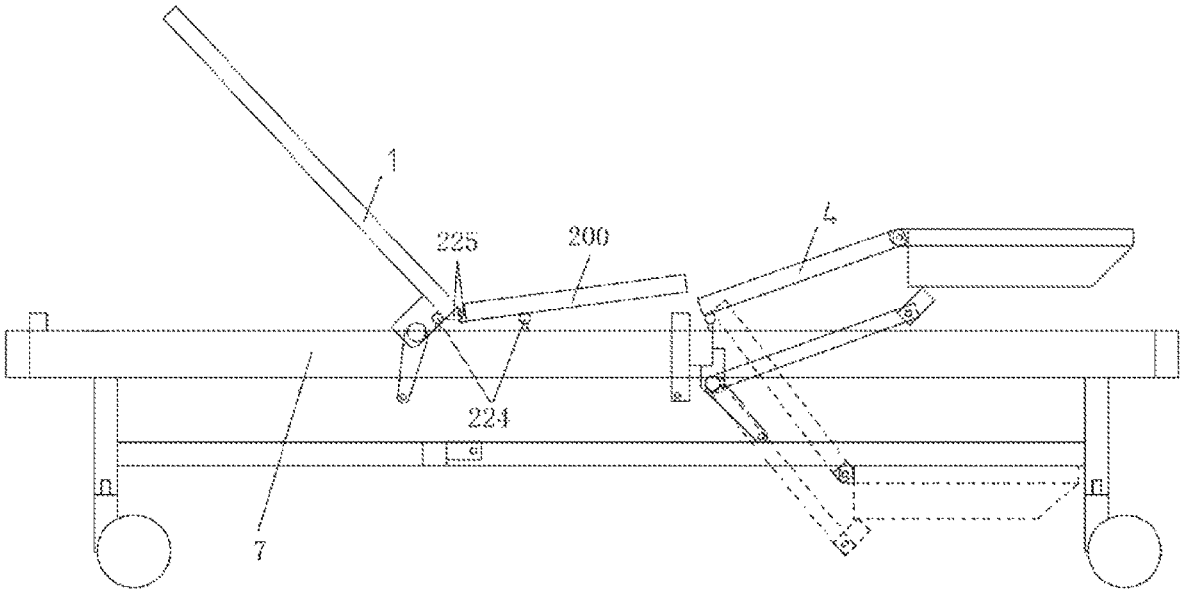
FIG. 22 is a working state schematic diagram of a leg lifting and dropping bed for preventing a person from sliding down when sitting up or down in accordance with at least one embodiment of the present disclosure.
Figure 23:
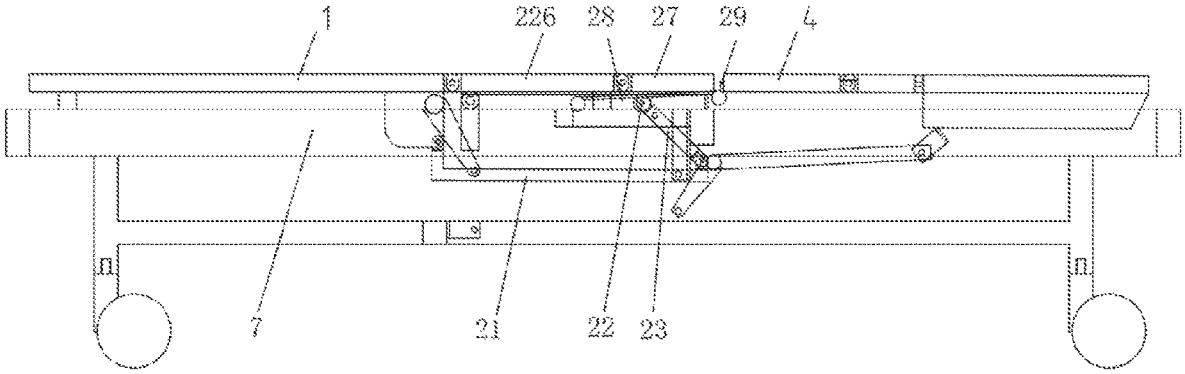
FIG. 23 is a structural schematic diagram of a leg lifting and dropping bed for preventing a person from sliding down when sitting up or down in accordance with at least one embodiment of the present disclosure.
Figure 24:
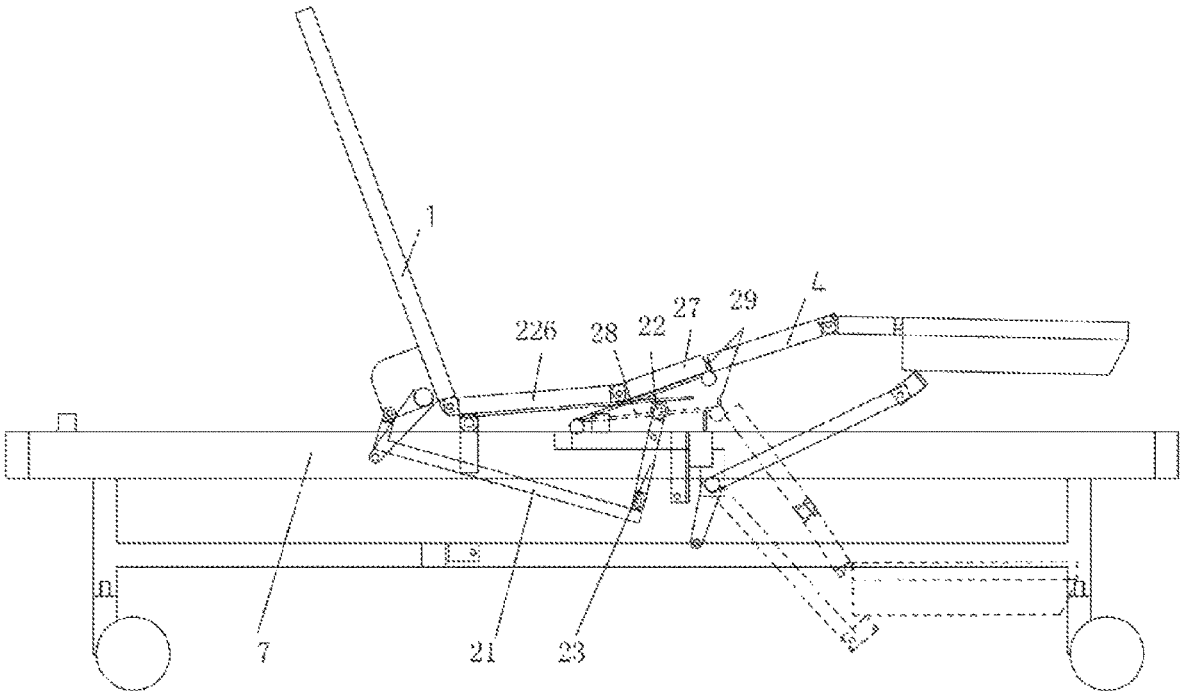
FIG. 24 is a working state schematic diagram of a leg lifting and dropping bed for preventing a person from sliding down when sitting up or down in accordance with at least one embodiment of the present disclosure.
Figure 25:
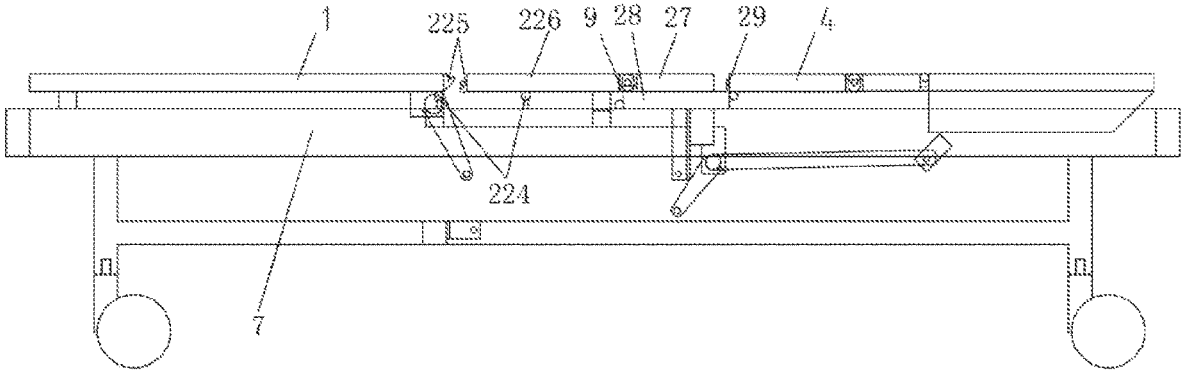
FIG. 25 is a structural schematic diagram of a leg lifting and dropping bed for preventing a person from sliding down when sitting up or down in accordance with at least one embodiment of the present disclosure.
Figure 26:
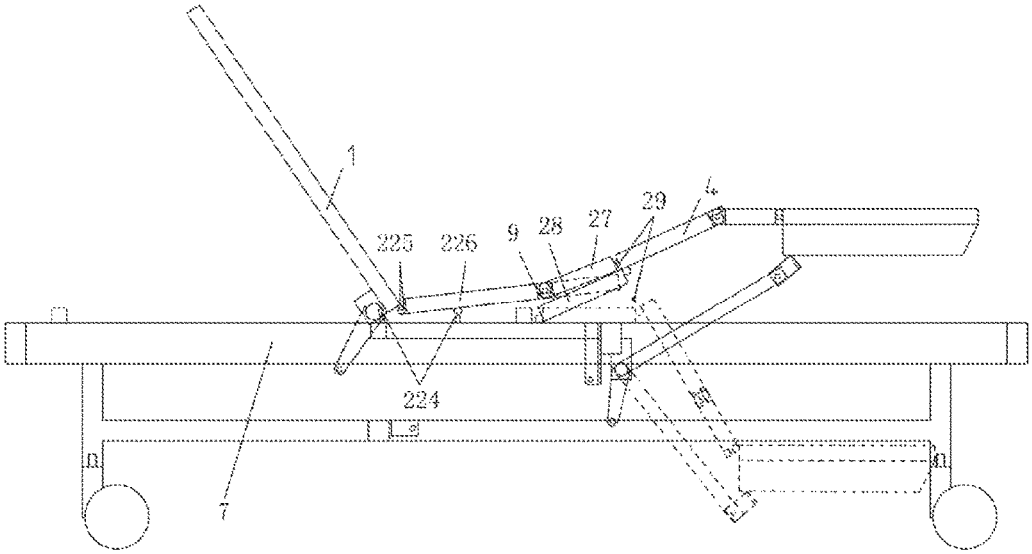
FIG. 26 is a working state schematic diagram of a leg lifting and dropping bed for preventing a person from sliding down when sitting up or down in accordance with at least one embodiment of the present disclosure.

FIG. 18 is a structural schematic diagram of the nursing bed in accordance with at least one embodiment of the present disclosure. As shown in FIG. 18, the back plate 1, the seat plate 2, the seat leg plate 3, the leg plate 4, the leg foot plate 5 and the foot plate 6 are surrounded by the bed body bracket 7.

A nursing bed, for preventing a person from sliding down when sitting up or down, which is according to some embodiments of the present disclosure, will now being described with reference to FIGS. 19-22. The seat leg portion 200 can be a complete panel, that is, the seat plate and the seat leg plate are integrally formed. The end portion of the seat leg portion 200, adjacent to the back plate 1, is hinged to the upper surface of the bed body bracket 7. The end portion of the back plate 1, adjacent to the seat leg portion 200, is hinged to the upper surface of the bed body bracket 7 or hinged to the seat leg portion 200. The end portion of the leg plate 4, adjacent to the leg portion 200, is hinged to the bed body bracket 7, and horizontal connecting rods 21, pivotably connected to the lower surface of the back plate 1, are symmetrically arranged at the front end of the back plate 1, the horizontal connecting rod 21 is movably connected to the vertical connecting rod 23, the vertical connecting rod 23 is rotatably connected to the bed body bracket 7, a roller 22 is arranged at the upper end of the vertical connecting rod 23. When the back plate 1 is lifted up, the vertical connecting rod 23 is pulled by the horizontal connecting rod 21 to rotate, and the roller 22 applies strength on the lower surface of the seat leg portion 200. Although the roller 22 is illustrated in FIGS. 19 to 22, those skilled in the art will appreciate that the sliding connection between the vertical connecting rod 23 and the lower surface of the seat leg portion 200 can also be achieved in other ways, and the present disclosure is not limited thereto. In some embodiments, the gear wheel portion 225, which mutually matched, having respective support shaft 224 as the rotation center, are arranged at the end portion of the back plate 1 adjacent to the seat leg portion 200. In one embodiment, the mutually matched gear wheel portion 225 can be levering members acting like the gear wheel.

Although in FIGS. 19 to 22, the bed body bracket 7 is arranged under the back plate 1, the seat leg portion 200, the leg plate 4, and the foot plate, however, in some embodiments according to the present disclosure, the bed body bracket 7 may also arranged under the back plate 1 and the seat leg portion 200, and surrounding the leg plate 4 and the foot plate, and separated apart from the leg plate 4 and the foot plate. In an embodiment, the bed body bracket 7 can also be flush with the leg plate 4 and the foot plate.

A nursing bed, for preventing a person from sliding down when sitting up or down, which is according to some embodiments of the present disclosure, will now being described with reference to FIGS. 23-26. The nursing bed includes a seat plate 226 and a seat leg plate 27. The seat plate 226 and the seat leg plate 27 are connected above by a hinge by means of the seamless abutting joint connecting or the gap abutting joint connecting. A clipping block 9 is arranged inside the gap when the seat plate 226 and the seat leg plate 27 are connected by means of the gap abutting joint connecting, wherein the clipping block 9 is located on at least one of the opposite side surfaces of the seat plate 226 and the seat leg plate 27. The lower surface of the end portion of the seat plate 226, adjacent to the back plate 1, is hinged to the upper surface of the bed body bracket 7. The end portion of the back plate 1, adjacent to the seat plate 226, is hinged to the upper surface of the bed body bracket 7 or/and is hinged to the seat plate 226. The leg plate 4 is hinged to one end of the connecting rod 13, the other end of the connecting rod 13 is hinged to the upper surface of the bed body bracket 7. An upright baffle 29 is arranged at the end of the connecting rod 13 which hinged to the leg plate 4. The horizontal connecting rods 21, pivotably connected to the lower surface of the back plate 1, are symmetrically arranged at the front end of the back plate 1, the horizontal connecting rod 21 is movably connected to the vertical connecting rod 23, the vertical connecting rod 23 is rotatably connected to the bed body bracket 7, the roller 22 is arranged at the upper end of the vertical connecting rod 23. Although the roller 22 is illustrated in FIGS. 23 to 26, those skilled in the art will appreciate that the sliding connection between the vertical connecting rod 23 and the lower surface of the seat leg plate 27 can also be achieved in other ways, and the present disclosure is not limited thereto. When the back plate 1 is lifted up, the vertical connecting rod 23 is pulled by the horizontal connecting rod 21 to rotate, and the roller 22 applies strength on the lower surface of the seat leg plate 27. In some embodiments, the gear wheel portion 225, which mutually matched, having respective support shaft 224 as the rotation center, are arranged at the end portion of the back plate 1 adjacent to the seat plate 226. In one embodiment, the mutually matched gear wheel portion 225 can be levering members acting like the gear wheel.

Although in FIGS. 23 to 26, the bed body bracket 7 is arranged under the back plate 1, the seat plate 226 and the seat leg plate 27, the leg plate 4, the leg foot plate and the foot plate, however, in some embodiments according to the present disclosure, the bed body bracket 7 may also arranged under the back plate 1, the seat plate 226 and the seat leg plate 27, and surrounding the leg plate 4, the leg foot plate and the foot plate, and separated apart from the leg plate 4, the leg foot plate and the foot plate. In an embodiment, the bed body bracket 7 can also be flush with the leg plate 4, the leg foot plate and the foot plate.

The above structure ensures that the seat leg portion 200 is lifted by using the horizontal connecting rod 21, the vertical connecting rod 23 and the roller 22 when the back is raised. In some embodiments, the mutually matched gear wheel portion 225 can also be driven by the lifting process of the back plate 1 to drive the seat leg portion 200 or the seat plate 226 to be lifted. Since the leg plate 4 is only connected to the bed body bracket 7, the lifting of the seat leg portion 200 does not affect the dropping of the leg plate 4, so that the lying person can have a healthy posture of sitting right; meanwhile, the leg plate 4 can also be lifted in a flat state. When the nursing bed includes the seat plate 226 and the seat leg plate 27, the upright baffle 29, at the connecting rod 13 connected to the leg plate 4, enables the leg plate 4 to be lifted to a horizontal state at first, and when it needs to be kept lifting upward, the seat leg plate 27 and the leg plate 4 can be driven to lift together by the connecting rod 13, which can effectively lift human legs. If lifted in the back raising state, the human body gravity is ensured to occupy the back plate 1, the seat leg plate 27 and the leg plate 4, while the buttocks does not bear weight, which meets the ergonomic requirements. It will be understood by those skilled in the art that only relevant components are described in the above description with reference to FIGS. 19 to 26, and descriptions of other components are omitted, the detailed description of other components can be referred to the description of FIGS. 1 to 18 in the present disclosure.

It should be understood by those skilled in the art that the present invention is not limited by the scope of the disclosure. Other variations or modifications may be made by those skilled in the art based on the above disclosure, and such changes or modifications are still within the scope of the present disclosure.

What is claimed is:

1. A nursing bed, wherein said nursing bed comprises:

a back plate portion, a seat plate portion, a seat leg plate portion, a leg plate portion and a foot plate portion, the seat plate portion and the seat leg plate portion are hinged, and the leg plate portion and the foot plate portion are hinged;

a bed body bracket, which configures the back plate portion, the seat plate portion and the seat leg plate portion, and the seat plate portion being fixedly connected to the bed body bracket;

a rotating shaft, which is arranged on the bed body bracket and arranged at a lower side of the seat leg plate portion, and;

a connecting rod, wherein an end is pivotably connected to the rotating shaft, while another end is movably connected to a lower surface of the foot plate, wherein the leg plate portion is hinged to the bed body bracket with the connecting rod, and an upright baffle, used to prevent the leg plate portion from rotating, is arranged at an end portion of the connecting rod, which is hinged to the leg plate portion, and the connecting rod extends to a lower side of the seat plate portion.

2. The nursing bed according to claim 1, wherein the seat leg plate portion and the leg plate portion are connected by a first hinge.

3. The nursing bed according to claim 2, wherein a clipping block is arranged on at least one of opposite side surfaces of the seat leg plate portion and the leg plate.

4. The nursing bed according to claim 3, wherein the leg plate portion comprises a leg plate and a leg foot plate, and the leg plate and the leg foot plate are connected by a second hinge, the leg foot plate and the foot plate are connected by a third hinge.

5. The nursing bed according to claim 4, wherein the leg plate includes a center leg plate, a left leg plate and a right leg plate, and the left leg plate and the right leg plate are symmetrically arranged on both sides of the center leg plate;

the leg foot plate includes a center leg foot plate, a left leg foot plate and a right leg foot plate, and the left leg foot plate and the right leg foot plate are symmetrically arranged on both sides of the center leg foot plate;

the foot plate portion includes a center foot plate, a left foot plate and a right foot plate, and the left foot plate and the right foot plate are symmetrically arranged on both sides of the center leg plate; and the connecting rod includes a center connecting rod, the rotating shaft including a center rotating shaft, one end of the center connecting rod is pivotably connected to the center rotating shaft, the center connecting rod is movably connected to a lower surface of the center foot plate.

6. The nursing bed according to claim 5, wherein the two sides of the lower surface of the center foot plate are respectively provided with sustaining sticks extending to the lower side of the left foot plate and the right foot plate.

7. The nursing bed according to claim 5, wherein:

a left connecting rod is arranged on the lower surface of the left foot plate, and one end of the left connecting rod is movably connected to the lower surface of the left foot plate, and a left rotating shaft, which is concentrically connected to the central rotating shaft, is arranged on the bed body bracket, the other end of the left connecting rod is pivotably connected to the left rotating shaft;

a right connecting rod is arranged on the lower surface of the right foot plate, and one end of the right connecting rod is movably connected to the lower surface of the right foot plate, and a right rotating shaft, which is concentrically connected to the central rotating shaft, is arranged on the bed body bracket, the other end of the right connecting rod is pivotably connected to the right rotating shaft.

8. The nursing bed according to claim 7, wherein both end surfaces of the central rotating shaft, the right end surface of the left rotating shaft, and the left end surface of the right rotating shaft are arranged with tenons and grooves, and the tenons and the grooves are concentrically connected.

9. The nursing bed according to claim 5, wherein:

the seat plate portion includes a center seat plate, a left leg plate and a right leg plate, the left leg plate and the right leg plate are symmetrically arranged on both sides of the center seat plate;

the seat leg plate portion includes a center seat leg plate, a left seat leg plate and a right seat leg plate, and the left seat leg plate and the right seat leg plate are symmetrically arranged on both sides of the center seat leg plate.

10. The nursing bed according to claim 1, wherein the seat plate portion and the seat leg plate portion are integrally formed.

11. The nursing bed of claim 1, wherein the seat plate portion is hinged to the bed body bracket, the nursing bed further comprises a horizontal connecting rod and a vertical connecting rod, the horizontal connecting rod is pivotably connected with the back plate portion, and is movably connected with the vertical connecting rod, the vertical connecting rod is rotatably connected with the bed body bracket.

12. The nursing bed according to claim 1, wherein the back plate portion and the seat plate portion are rotatably connected to the bed body bracket, and a first gear wheel portion is arranged on a side surface of the back plate portion, which is adjacent to the seat plate portion, and a second gear wheel portion, matching the first gear portion, is arranged on the side surface of the seat plate portion, which is adjacent to the back plate portion.

13. The nursing bed according to claim 1, wherein an end portion of the leg plate portion, which is adjacent to the seat plate portion, is hinged to the bed body bracket.

14. The nursing bed according to claim 1, wherein the upright baffle is perpendicular to an upper surface of the connecting rod.

15. The nursing bed according to claim 1, wherein the bed body bracket is arranged under the back plate portion, the seat plate portion, and the seat leg plate portion, and surrounding the leg plate portion and the foot plate portion, and separated apart from the leg plate portion and the foot plate portion.

16. The nursing bed according to claim 15, wherein the bed body bracket is flush with the leg plate portion and the foot plate portion.

17. The nursing bed according to claim 4, wherein the bed body bracket is arranged under the back plate portion, the seat plate portion, and the seat leg plate portion, and surrounding the leg plate portion and the foot plate portion, and separated apart from the leg plate portion and the foot plate portion.

18. The nursing bed according to claim 17, wherein the bed body bracket is flush with the leg plate portion and the foot plate portion.

* * * * *